US006837404B2

(12) United States Patent
Torres et al.

(10) Patent No.: US 6,837,404 B2
(45) Date of Patent: Jan. 4, 2005

(54) FLEXIBLE TUBE LIQUID DELIVERY SYSTEM

(75) Inventors: Adán E. Torres, Woodburn, OR (US); Judith Margaret Bridenbaugh, Portland, OR (US); Samuel Edgar Johnson, Portland, OR (US); Robert Harlan Bridenbaugh, Portland, OR (US)

(73) Assignee: R. Harlan Bridenbaugh, Portland, OR (US)

( * ) Notice: Subject to any disclaimer, the term of this patent is extended or adjusted under 35 U.S.C. 154(b) by 0 days.

(21) Appl. No.: 10/429,135

(22) Filed: May 2, 2003

(65) Prior Publication Data

US 2003/0218030 A1 Nov. 27, 2003

Related U.S. Application Data

(60) Provisional application No. 60/383,272, filed on May 22, 2002.

(51) Int. Cl.[7] ..... B67D 5/00
(52) U.S. Cl. ..... 222/464.4; 222/383.1
(58) Field of Search ..... 222/383.1, 464.3, 222/464.4

(56) References Cited

U.S. PATENT DOCUMENTS 1,293,850 A * 2/1919 Mathis ..... 222/401
1,887,013 A * 11/1932 Coffield ..... 169/72
1,952,745 A * 3/1934 Deasy ..... 33/392
3,708,231 A * 1/1973 Walters ..... 356/152.1
4,273,272 A * 6/1981 Blanc ..... 222/464.4
5,195,664 A * 3/1993 Rhea ..... 222/464.4
5,215,227 A * 6/1993 Farner ..... 222/175
5,934,519 A * 8/1999 Kim et al. ..... 222/464.4
6,394,319 B1 5/2002 Pucillo

* cited by examiner

*Primary Examiner*—J. Casimer Jacyna

(57) ABSTRACT

A system utilizing a flaccid tube for delivery of liquids with a spray container is disclosed. This device can be substituted for the usual straight, non-flaccid tubing widely used with liquid dispensing containers. The system consists of a flexible tube and a weight attached to the end which causes the tube to seek the liquid, regardless of bottle or vessel position. The weight is attached to the tubing by a bushing or sleeve which inserts into the distal end of the flexible tube, compressing the tube walls outward resulting in a secure and tight attachment of the weight. The system allows the user to easily spray, squirt or expel liquids from any orientation which includes complete inversion of the container. The weight design components are inexpensive to manufacture, and can be easily attached to an existing spray bottle, and can thus be used, transferred, and re-used multiple times thus conserving resources.

21 Claims, 5 Drawing Sheets

FLEXIBLE TUBE LIQUID DELIVERY SYSTEM

This application claims benefit of 60/383,272 filed May 22, 2002.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

This invention relates to a flexible tube system for dispensing liquid from a container that can deliver liquids regardless of position, including being completely inverted.

Containers for this purpose generally consist of a spray head, a pumping mechanism, and a rigid tube to feed liquid into the spray mechanism. Such containers work only when the container is vertical or slightly tipped. The rigid tube that conveys fluid from the container typically sits just above or touches the bottom surface of the container. If the container is turned sideways or upside-down, the tube draws only air which comes out the spray head. Previous art has taught flexible tubing with a weighted end so that liquid is delivered to the spray mechanism, regardless of the position of the vessel. However, these systems require a weight assembly that is not optimal in terms of the shape or manner of attachment.

U.S. Pat. No. 6,394,319-B1 (to Pucillo) teaches a liquid dispenser which includes a flexible tube and a weighted liquid intake component. The weight has a cylindrical configuration with openings at each end. The means of attaching the weight to the tube relies on insertion of a stem on the weight into the distal opening of the tube.

This prior art teaches a weight configuration which may be unreliable in that the weight is not actively secured in place by a specific force other than being inserted into the tube. Moreover, the cylindrical shape will not move freely within ail container contours, particularly those with a narrow neck containing a small volume of liquid when inverted.

BRIEF SUMMARY OF THE INVENTION

The present invention consists of a flexible tube system for use in containers for continuously dispensing liquid when the container is in any spatial orientation, including a completely inverted position.

The flexible tube system is composed of a tube with a first end for connecting with a pump type dispenser of a liquid dispensing container. The opposite end has a weight with a center channel, through and through, so that the tube can be threaded through the weight and connected by means of a bushing or small tubular sleeve. The bushing or sleeve is inserted into the distal opening of the tube, and inserted into the distal opening of the weight. Such connection compresses the flexible tube wall against the center channel of the weight, thus providing a tight connection that actually is strengthened by weight or force applied distally.

The weight has a tapered end, shaped much like a "plumb bob", that assures free motion through liquid as well as allowing contact with liquid in all container orientations. The tapered weight end can seek very small amounts of fluid when the container is completely inverted.

The flexible tube is sufficiently flaccid to allow the weight inlet to move freely with liquid inside a liquid dispensing container. The weight inlet has a sufficient weight so that the weight moves in the same direction of liquid movement inside the dispensing container. The weight inlet and the intake opening stays under the surface of the liquid when the liquid dispensing container is moved in any direction, including complete inversion.

This flexible tube system is reliable, easily manufactured, easily installed, and can be sold individually for use with existing liquid dispensing containers, resulting in lowered cost to the consumer as well as conservation of resources.

DETAILED DESCRIPTION OF THE INVENTION

Most liquid dispensing containers include a dispenser which has a dispensing mechanism, an intake port and a connector; a liquid container connected to the liquid dispenser; and a rigid liquid inlet tube. The present invention utilizes a flexible tube system for use in liquid dispensing containers for continuously dispensing liquid from all positions including an inverted position.

Figure 1:
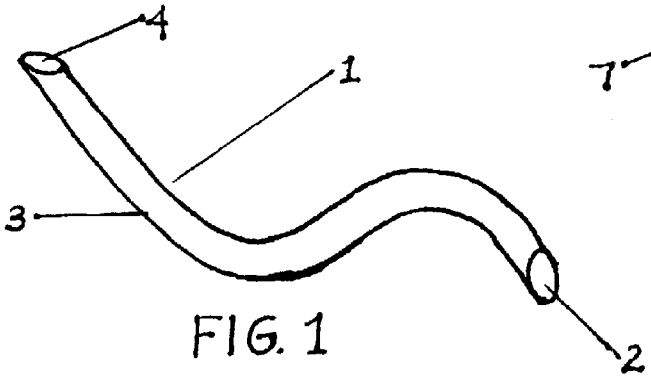
FIG. 1 shows the flexible tube.

In one embodiment, the flexible tube system comprises a flexible tube 1 and a distal end 2, as illustrated in FIG. 1. The tube walls 3 are sufficiently thin to allow good flexibility. This flexible tube has two ends, wherein the first end 4 is for connecting with the rigid tube of a common liquid dispenser of a liquid dispensing vessel.

Figure 2:
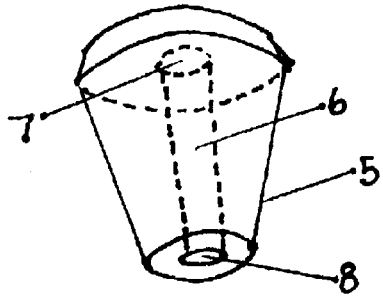
FIG. 2 shows the weight inlet.

The weight FIG. 2 has a tapered end (bottom) 5, and a center channel 6 with one opening 7 at the top, and another opening at the bottom 8. The weight is secured to the distal tube opening by means of a bushing 9, FIGS. 3A, 3B, 3C, 3D or tubular sleeve 10, FIG. 3E. The bushing has a center channel 11, and a stem 12 that is inserted into the distal inlet opening 2 inside the tube walls 3, and then pushed into the weight bottom opening 8, FIG. 3D which compresses the tube walls, resulting in a tight and secure connection. The bushing may have multiple channels feeding into the central channel than can have an open or blocked end, FIGS. 3B, 3C.

The flexible tube is sufficiently flaccid to allow the weight inlet to move freely within liquid when used inside a liquid dispensing container. The flexible tube can be made of soft polymers, silicone, latex or non-latex rubber or other suitable materials.

Figure 4:
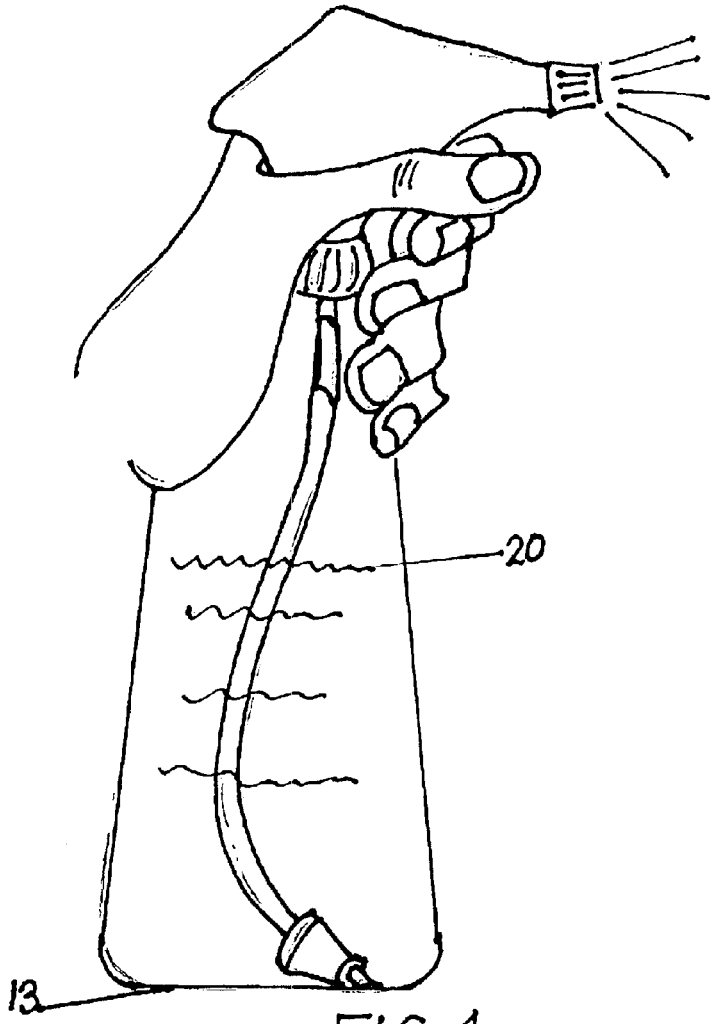
FIG. 4 shows a spray bottle with flexible tube assembly in an upright position.
Figure 5:
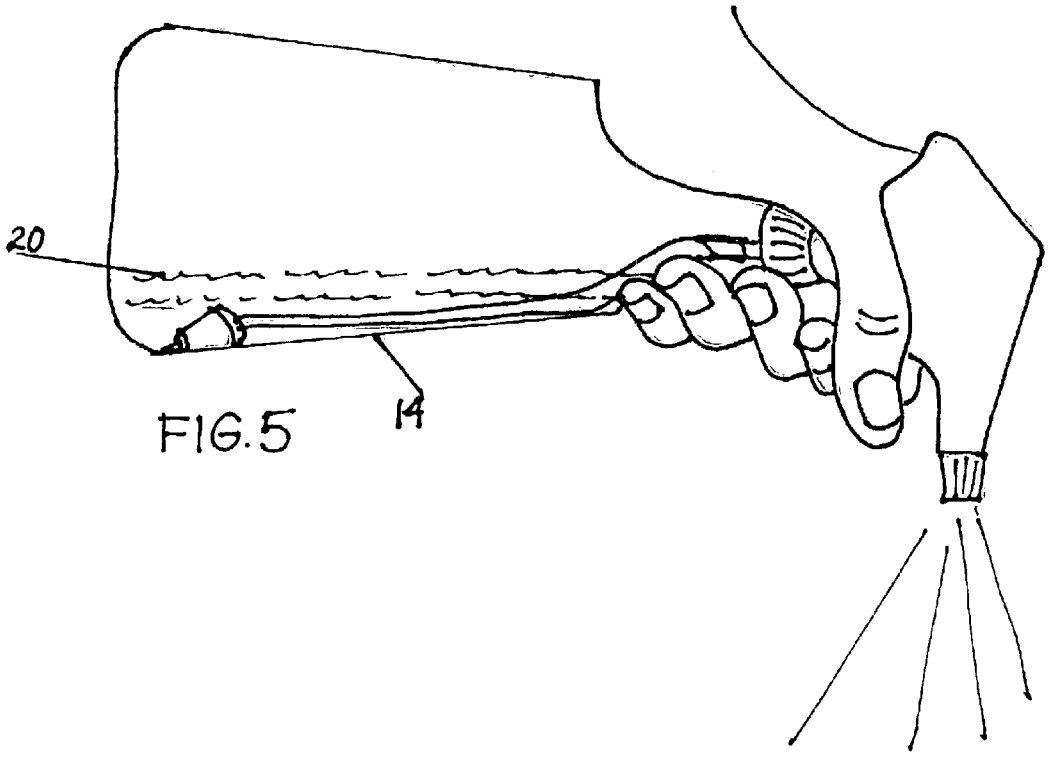
FIG. 5 shows a spray bottle with flexible tube assembly in a tilted position.
Figure 6:
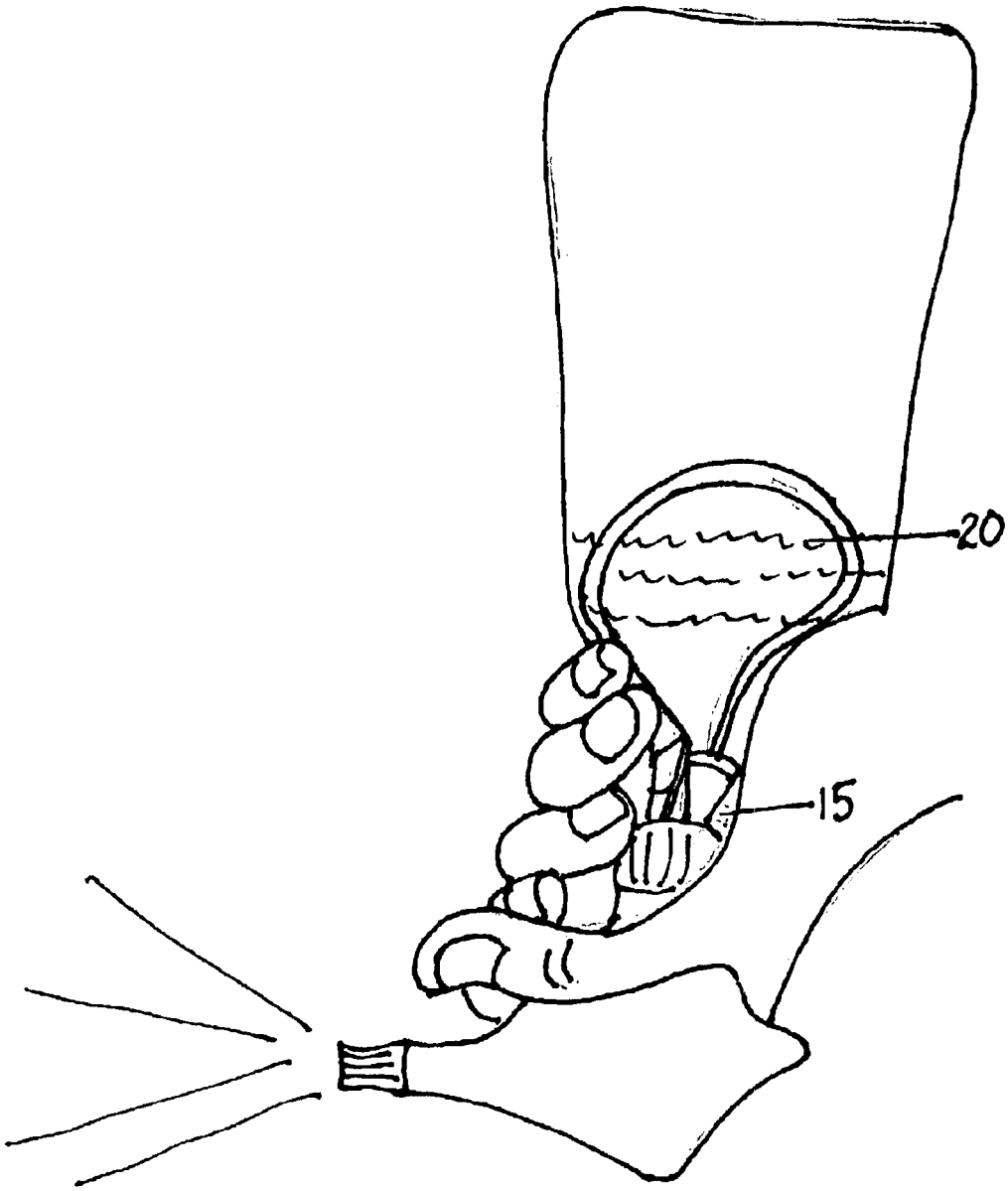
FIG. 6 shows a spray bottle with flexible tube assembly in a completely inverted position.

It is important that the flexible tube is of sufficient length so that the connected weight inlet can reach and be in contact with the bottom 13, FIG. 4 and side walls of the container 14, FIG. 5 and be in contact with the connector 15, FIG. 6 of the liquid dispenser when the bottle is in an inverted position. As illustrated in the figures, due to a high degree of elasticity of the flexible tube, no kinking occurs.

The weight should be sufficiently dense that so that the weight inlet can move within the liquid when the container is tilted, as shown in FIG. 5. The weight inlet is nonbuoyant and it remains submerged.

This design insures a continuous delivery of liquid through the intake opening of the weight inlet into the flexible tube, and further to the liquid dispenser. In particular, when a small amount of liquid remains in the bottle, the weight inlet is still able to pick up the liquid through the tapered end, even when inverted FIG. 6.

Figure 3A:
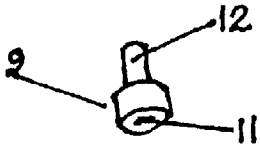
FIG. 3A shows a bushing which secures the weight to the distal end of tube.
Figure 3B:
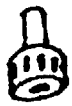
FIG. 3B shows a bushing that has multiple channels feeding into the central channel.
Figure 3C:
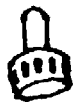
FIG. 3C shows a bushing with multiple channels feeding into the central channel, but the end is blocked.
Figure 3D:
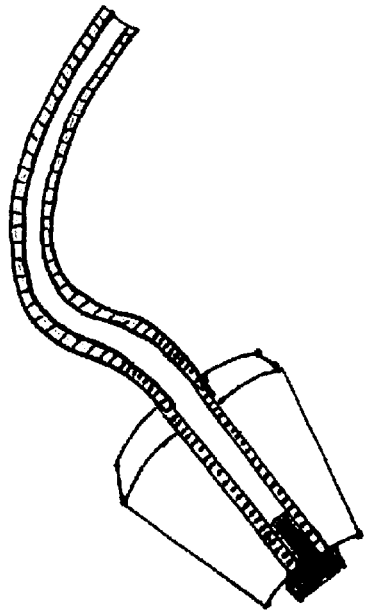
FIG. 3D shows a mid-sectional view of the flexible tube attached to the weight by the bushing.
Figure 3E:
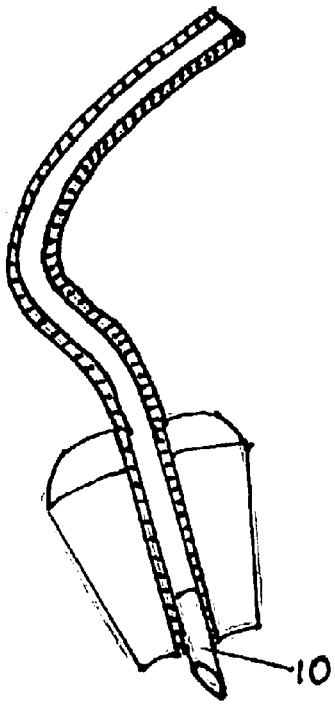
FIG. 3E shows a mid-sectional view of the flexible tube attached to the weight by a firm tubular sleeve inserted into the flexible tube.

The bushing design FIG. 3B allows for influx of liquid through multiple channels thus enhancing the flow of liquid. The bushing design FIG. 3C could be used when it is desireable to filter out particulate matter.

The weight intake can be made of a variety of materials including (but not limited to), metal, ceramics, glass, and high density plastics. The density of the materials should be greater than 1.0 gm/cc (specific gravity greater than 1). Additionally, the weight inlet can be manufactured in a variety of colors and designs for decorative or brand identification purposes.

FIG. 5 illustrates the operating mechanism of the flexible tube system when the bottle is substantially tilted. As shown, the weight inlet moves in the same direction of the liquid because of gravity. Therefore, the weight inlet always stays under surface 20 of liquid regardless of the direction of tilting. Since the tube is highly flexible, it moves freely with the weight inlet without sharp bending or kinking. This feature provides continuous liquid delivery when the user moves the container in any direction.

FIG. 6 illustrates an extreme condition of the liquid dispensing container's position. The bottle is completely upside down from its upright position. This frequently occurs, for example, when spraying cleansing liquids in ovens, sinks or toilets. As shown, the weight inlet has moved 180 degrees from its placement in an upright position. However, it still remains under the surface of the liquid 20, and is able to deliver essentially ail fluid in the container because of its tapered shape.

As exemplified by FIGS. 4, 5, and 6 the utility and advantages of the flexible tube system of the present invention has many uses that are apparent. Therefore, the flexible tube system of the present invention solves problems with existing spray bottles that inconsistently supply liquid when tilted, and completely fail to supply liquid when inverted.

The flexible tube system can be sold as a kit, or an assemblage, and can easily be substituted for the rigid plastic tube in existing liquid dispensing containers. One flexible tube system can work with a variety of containers simply by cutting the tube to the appropriate length.

The flexible tube system can also be decorative in appearance, by utilizing different colors of tubing and weight inlets.

Figure 7A:
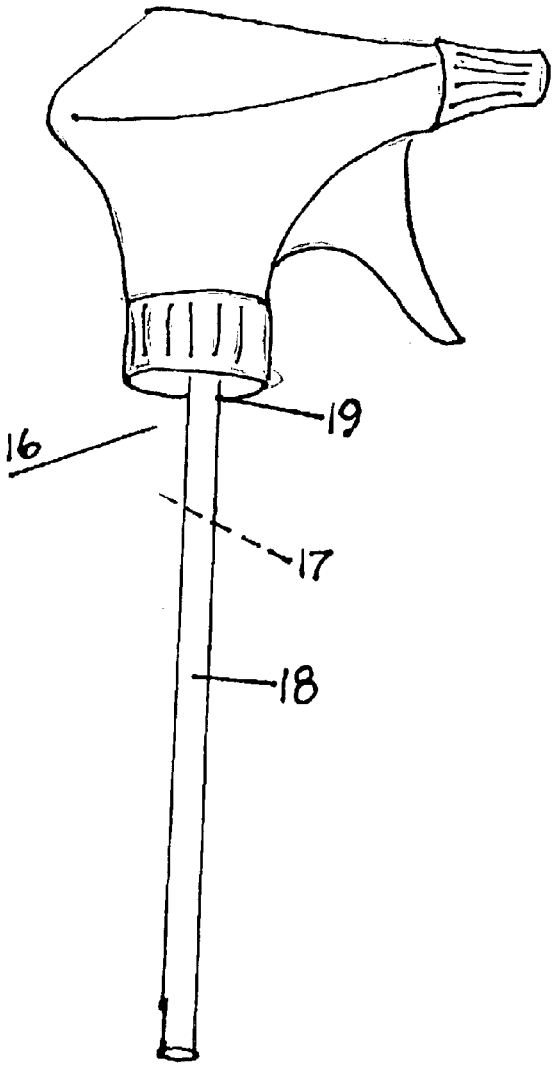
FIG. 7A shows a common spray mechanism with a rigid liquid delivery tube.
Figure 7B:
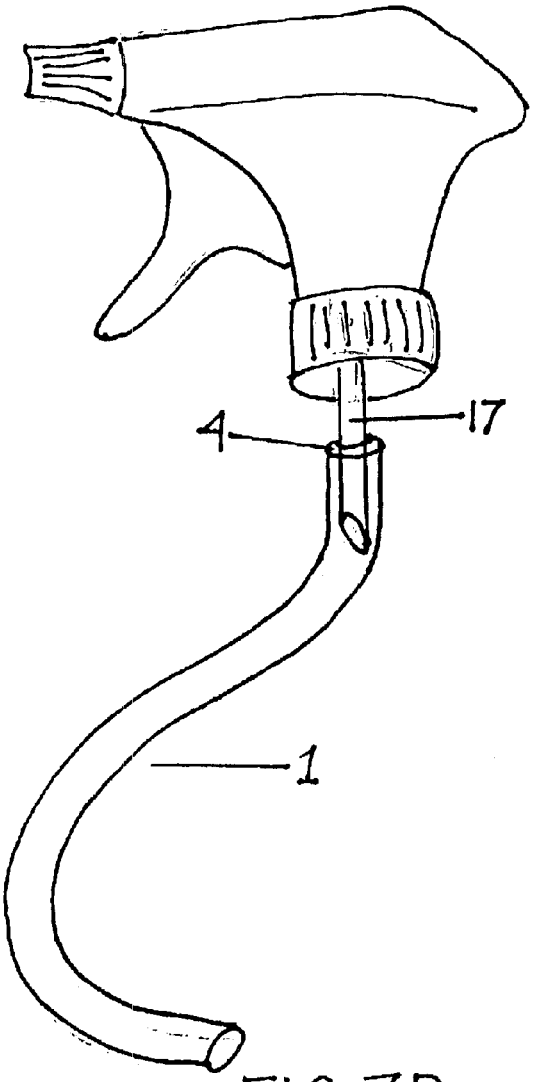
FIG. 7B shows the flexible tube applied over the rigid delivery tube.

The kit or assemblage can also include instructions on how to use the flexible tube system with existing liquid dispensing bottles or other containers. FIG. 7A shows the commonly available pump mechanism for spray bottles 16. The consumer may cut 17 the existing, rigid feed tube 18 at a forty-five degree angle near the proximal end of the intake port 19 and fit the first end 4 of the flexible tube 1 over the stem of the cut rigid feed tube 17, FIG. 7B.

The present invention, which has been described in detail and pictorially shown in the accompanying drawings, represents a basic, practical and inexpensive system for adapting a liquid dispensing container in a way that is reliable, and easy to assemble and use.

What is claimed is:

1. An assemblage of flexible tube spray container delivery system comprised of:

(a) a flaccid tube which connects at one end with a dispensing mechanism of a liquid dispensing container, and (b) a weight connected on the outside of the opposite end of said flaccid tube, wherein said weight consists of a tapered or plumb bob shape with a center channel so that the flexible tube can be threaded through to the distal end of the weight allowing for a bushing to be inserted to secure the weight in place, wherein said bushing has a central channel as well as a number of radiating channels feeding into the central channel.

2. The assemblage of claim 1, wherein said flexible tube is sufficiently flexible to allow said weight to move easily within liquid when used inside said liquid dispensing container, said flexible tube may be either straight or helical in shape.

3. The assemblage of claim 1, wherein said flexible tube is composed of silicone, soft polymers, latex and non-latex rubber, or other suitable materials.

4. The assemblage of claim 1, wherein said weight has a tapered shape, proximal to distal.

5. The assemblage of claim 1, wherein said bushing central channel extends through and through, thus forming an opening at the distal end of said channel for drawing liquid through said channel into said flexible tube for dispensing.

6. The assemblage of claim 1, where said bushing central channel has the distal end blocked.

7. The assemblage of claim 1, wherein said weight is sufficiently dense so that said weight moves the tube inside said liquid dispensing container, and said liquid intake opening stays under the surface of liquid when said liquid dispensing container is tilted in any direction.

8. The assemblage of claim 1, wherein said weight, which includes the bushing, is made from materials having density greater than 1.0 g/cc (specific gravity>1.0).

9. The assemblage of claim 1, wherein said materials comprising the weight and the bushing is composed of metal, ceramic, glass, high density plastics, or other suitable materials.

10. The assemblage of claim 1 further including a liquid dispenser which has a liquid dispensing mechanism, an intake pod, and a connector for connecting to a liquid container.

11. The assemblage of claim 10, wherein said liquid dispensing mechanism is a pumping mechanism for spraying, squirting or expelling liquids.

12. A liquid dispensing vessel containing a flexible tube assembly consisting of:

(a) a liquid dispenser having a liquid dispensing mechanism, an intake pod, and a connector, (b) a container connected to said liquid dispenser through said connector, (c) a sufficient length of flexible tube to allow contact with fluids in all spatial orientations of the container whose proximal end connected to said intake port of said liquid dispenser, (d) a weight in the shape of a plumb bob with the distal end of said flexible tube threaded through the center channel, and secured with a bushing to the distal end of end of said flexible tube which then forms a liquid intake opening, wherein said bushing has a central channel as well as a number of radiating channels feeding into the central channel.

13. The vessel of claim 12, wherein said flexible tube is sufficiently flexible to allow said weight to move easily within liquid when used inside said liquid dispensing container, said flexible tube may be either straight or helical in shape.

14. The vessel of claim 12, wherein said flexible tube is composed of silicone, soft polymers, latex and non-latex rubber, or other suitable materials.

15. The vessel of claim 12, wherein said weight has a tapered shape, proximal to distal.

16. The vessel of claim 12, wherein said bushing central channel extends through and through, thus forming an opening at the distal end of said channel for drawing liquid through said channel into said flexible tube for dispensing.

17. The vessel of claim 12, where said bushing central channel has the distal end blocked.

18. The vessel of claim 12, wherein said weight is sufficiently dense so that said weight moves the tube inside said liquid dispensing container, and said liquid intake opening stays under the surface of liquid when said liquid dispensing container is tilted in any direction.

19. The vessel of claim 12, wherein said weight, which includes the bushing, is made from materials having density greater than 1.0 g/cc (specific gravity>1.0).

20. The assemblage of claim 12, wherein said materials comprising the weight and the bushing is composed of metal, ceramic, glass, high density plastics, or other suitable materials.

21. The vessel of claim 12, wherein said liquid dispensing mechanism is a pumping mechanism for spraying, squirting or expelling liquids.

* * * * *